US005818336A

United States Patent [19]

Varga et al.

[11] Patent Number: 5,818,336

[45] Date of Patent: Oct. 6, 1998

[54] DROP BOX INVENTORY MONITORING AND CONTROL SYSTEM

[75] Inventors: Steve Varga, Memphis; Thomas H. Jones, Germantown; Robert M. Cowling, Memphis, all of Tenn.

[73] Assignee: Skywire, LLP, Memphis, Tenn.

[21] Appl. No.: 582,752

[22] Filed: Jan. 4, 1996

[51] Int. Cl.[6] ..... G08B 13/08

[52] U.S. Cl. ..... 340/545; 340/569; 340/568; 340/539; 364/464.03; 232/33; 232/37

[58] Field of Search ..... 340/545, 569, 340/568, 539; 364/464.03; 232/33, 34, 35, 37, 36, 27

[56] References Cited

U.S. PATENT DOCUMENTS

| | | | |
|---|---|---|---|
| 3,581,980 | 6/1971 | Kreycile | 232/35 |
| 4,114,801 | 9/1978 | Van Orden | 232/17 |
| 4,738,392 | 4/1988 | Kovacs | 232/35 |
| 5,023,595 | 6/1991 | Bennett | 340/569 |
| 5,060,854 | 10/1991 | Armstrong | 232/37 |
| 5,092,233 | 3/1992 | Fox | 100/38 |
| 5,148,739 | 9/1992 | Fox | 100/45 |
| 5,481,464 | 1/1996 | Ramsden | 364/464.03 |
| 5,586,037 | 12/1996 | Gil et al. | 364/464.03 |

*Primary Examiner*—Jeffery Hofsass
*Assistant Examiner*—Benjamin C. Lee
*Attorney, Agent, or Firm*—Venable, Baetjer, Howard & Civiletti, LLP

[57] ABSTRACT

Apparatus and methods for controlling and monitoring pickup of packages deposited in a system of drop boxes, wherein each such drop box is adapted to receive a plurality of packages through a door, includes a drop sensor which is adapted to sense the deposit of a package through the door, means for communicating a plurality of signals indicative of the deposit of such package through the door, and a power supply which is operatively coupled to the drop sensor and communicating means for providing a source of power thereto. The drop sensor generally comprises means for passively detecting the passage of packages, and means for generating the plurality of signals indicative of the deposit of such packages through the door. Such plurality of signals include a signal to indicate that the drop box is approaching a "full box" condition, a signal to indicate that the drop box is at such "full box" condition, and a "pickup" signal to indicate that the courier has completed his daily rounds.

48 Claims, 6 Drawing Sheets

Asset Manager

File Edit Search Help

| ID | ROUTE NUM | CURRENT STATUS | NUMBER OF PKGS | PICKUP TIME | MESSAGES |
|---|---|---|---|---|---|
| | | EMPTY | 0 | 1900 | |
| | | PKGS PENDING | 28 | 1845 | PICKUP 1615 |
| | | 90%+CAPACITY | 45 | 1850 | PICKUP SCHD |
| | | !!PAST PICKUP!! | 33 | 1615 | PENDING ACT |
| | | !!PAST PICKUP!! | 10 | 1620 | SCHEDULED |
| | | PKGS PENDING | 2 | 1930 | SCHEDULED |

*Fig. 5*

Drop Box Manager

File Edit Search Help

ID 12345

ADDRESS

ROUTE XYZ

XYZ Office Bldg.
1st Floor

Current Count 2

Day's Count 15

Box Capacity 50

Scheduled Pickup 1930

Last Pickup 1942

| | |
|---|---|
| 1543 | Package Drop |
| 1530 | Package Drop |
| 1130 | Courier Pickup |
| 1050 | Package Drop |
| 0900 | Package Drop |

☑ RECOMMENDED ACTION

INITIALS

*Fig. 6*

Action Items

| ID | DATE/TIME | MESSAGE | ACTION REQUIRED |
|---|---|---|---|
| ☑ | 121295/0859 | LOW POWER | DISPATCH MAINTENANC |
| ☑ | 121295/0852 | DROP | NONE |
| ☑ | 121295/0850 | BOX FULL | PICKUP REQUIRED |
| ☐ | 121195/1857 | DROP | NONE |
| ☐ | 121195/1811 | DROP | NONE |
| ☐ | 121195/2042 | DROP | NONE |

DROP BOX INVENTORY MONITORING AND CONTROL SYSTEM

BACKGROUND OF THE INVENTION

The present invention relates generally to methods and apparatus for monitoring and controlling inventories, and more particularly to methods and apparatus for monitoring and controlling letters and/or packages in a drop box environment or in an "on-call" environment.

Express and "overnight" delivery services have become part and parcel of everyday business in today's competitive economy. For example, Federal Express (FedEx®) is considered to be the world's largest express package transportation company because it delivers an average of 2.4 million packages a day. About 45% of those packages pass through its superhub in Memphis, Tenn., while the rest go through regional hubs in Indianapolis, Ind., Newark, N.J., or Oakland, Calif. There are more than 115,000 FedEx® employees worldwide, serving about 210 countries, aboard more than 500 jets (fourth-biggest among U.S. airlines), 35,000 vehicles, and 31,000 drop boxes. An overnight package shipped from New York to Atlanta may be picked up in New York by a FedEx® courier at 7:52 p.m., and arrive by 9:27 p.m. at a New York FedEx® office, where it will be sorted and placed in a truck headed to FedEx®'s Newark, New Jersey regional hub. The package may then be sorted and loaded on a plane to Atlanta by 12:50 a.m., leave Newark at 2:37 a.m., arrive at an Atlanta FedEx® office. by 7:00 a.m., be loaded onto a FedEx® courier van for delivery by 8:00 a.m., and finally delivered to its recipient in Atlanta by 9:19 a.m. During its busiest last holiday season, FedEx® shipped 3.4 million packages, logged more than 380,000 telephone calls, and handled more than 21.5 million electronic transmissions per day. It can be seen, therefore, that there is a great need for more efficiently monitoring and controlling drop boxes or customer pick-up calls in such an environment.

SUMMARY OF THE INVENTION

Accordingly, it is a general object of the present invention enhance customer service and increase operational effectiveness in a drop box environment or an "on-call" environment.

It is a more specific object of the present invention to cost-efficiently determine in a timely manner which drop boxes do not need to be picked up at the close of a given business day, determine the specific time of a pickup at a particular drop box, eliminate missed pickups, reduce the number of telephone calls and the waiting period to answer those calls, and reduce the occurrences of "box full" conditions which may require customers to place their letters and/or packages outside of the drop box and, thereby, expose them to theft and/or damage.

It is a further specific object of the present invention to reduce overall system time, increase the number of drop box sites that an individual courier can service effectively, and provide independent data for the drop box provider to determine drop box utilization and placement parameters.

These and other objects, advantages, and novel features of the present invention are provided by apparatus and methods for controlling and monitoring pickup of packages deposited in a system of drop boxes, wherein each such drop box is adapted to receive a plurality of packages through a door, and includes a drop sensor which is adapted to sense the deposit of a package through the door, means for communicating a plurality of signals indicative of the deposit of such package through the door, and a power supply which is operatively coupled to the drop sensor and communicating means for providing a source of power thereto.

The drop sensor generally comprises means for detecting packages, and means for generating the plurality of signals indicative of the deposit of such packages through the door. Such plurality of signals include a signal to indicate that a package or packages have been dropped, a signal to indicate that the drop box is at "full box" condition, and a "pickup" signal to indicate that the courier has completed his daily rounds. In a first embodiment, the means for detecting packages is a means for passively detecting the passage of packages. In a second embodiment, the means for detecting packages is a means for physically detecting packages.

The drop sensor generally signals both package drop and full box. The output of the sensor is split between two different zone inputs on a modem interface circuitry. One zone input is set to react immediately to an output signal form the sensor. The other zone input only reacts after (x) seconds of the input signal being present. Thus, if the box is full, in continuously blocks the sensor and the sensor output remains high.

The drop box may further include a door switch that senses that the courier has opened a locked access door of the drop box to pick-up packages and commands the sending of message that the packages have been picked up.

These and other objects, advantages, and novel features according to the present invention will become more apparent from the following detailed description of a preferred embodiment thereof, when considered in conjunction with the accompanying drawings wherein:

BRIEF DESCRIPTION OF THE DRAWINGS

FIG. 5 is an illustration of an asset manager window used in an application of the drop box inventory monitoring and control system according to the present invention;

FIG. 6 is an illustration of a drop box manager window used in an application of the drop box inventory monitoring and control system according to the present invention;

DETAILED DESCRIPTION OF THE PREFERRED EMBODIMENT

Figure 1:
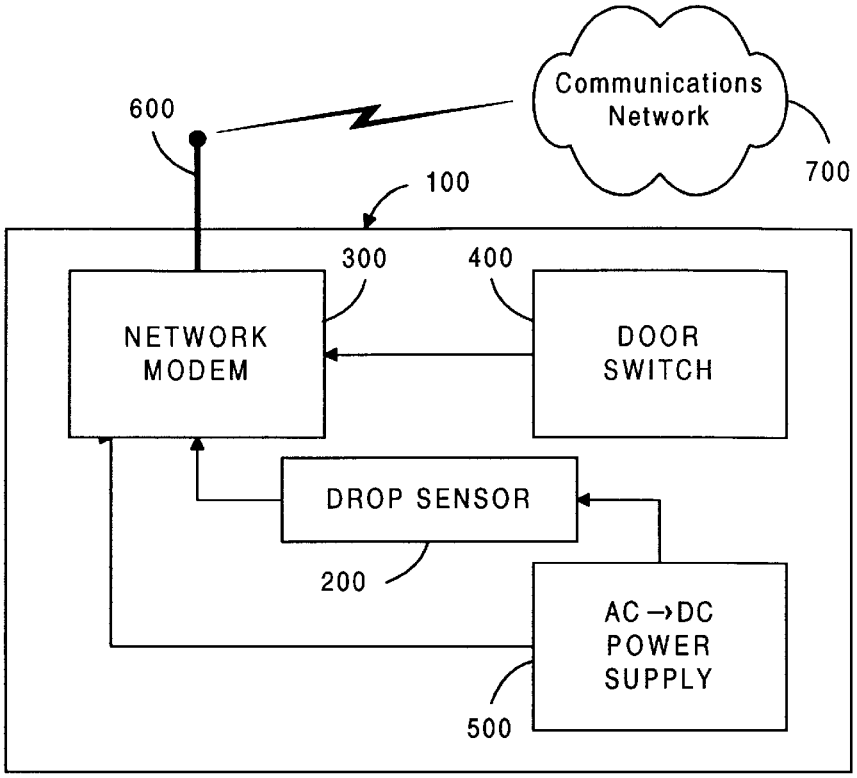
FIG. 1 is a block diagram of a drop box inventory monitoring and control system according to a presently preferred embodiment of the invention.
Figure 3:
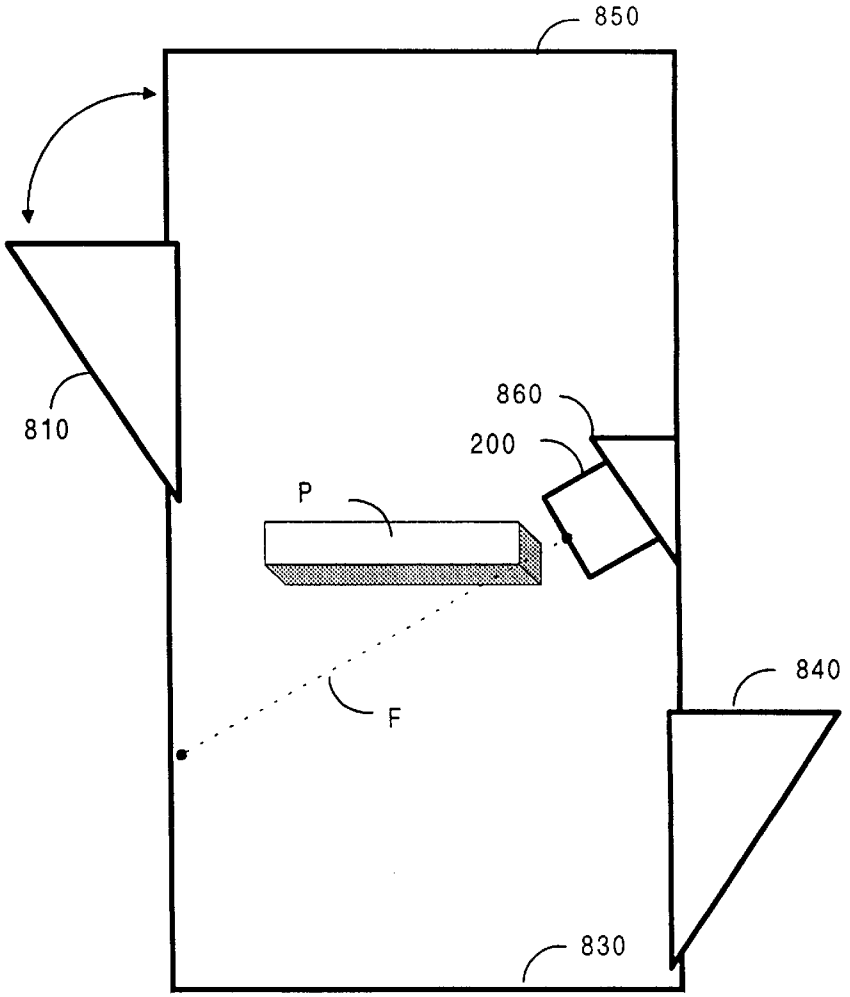
FIG. 3 is an illustration showing the deployment of a drop box inventory monitoring and control system according to another embodiment of the present invention.
Figure 2:
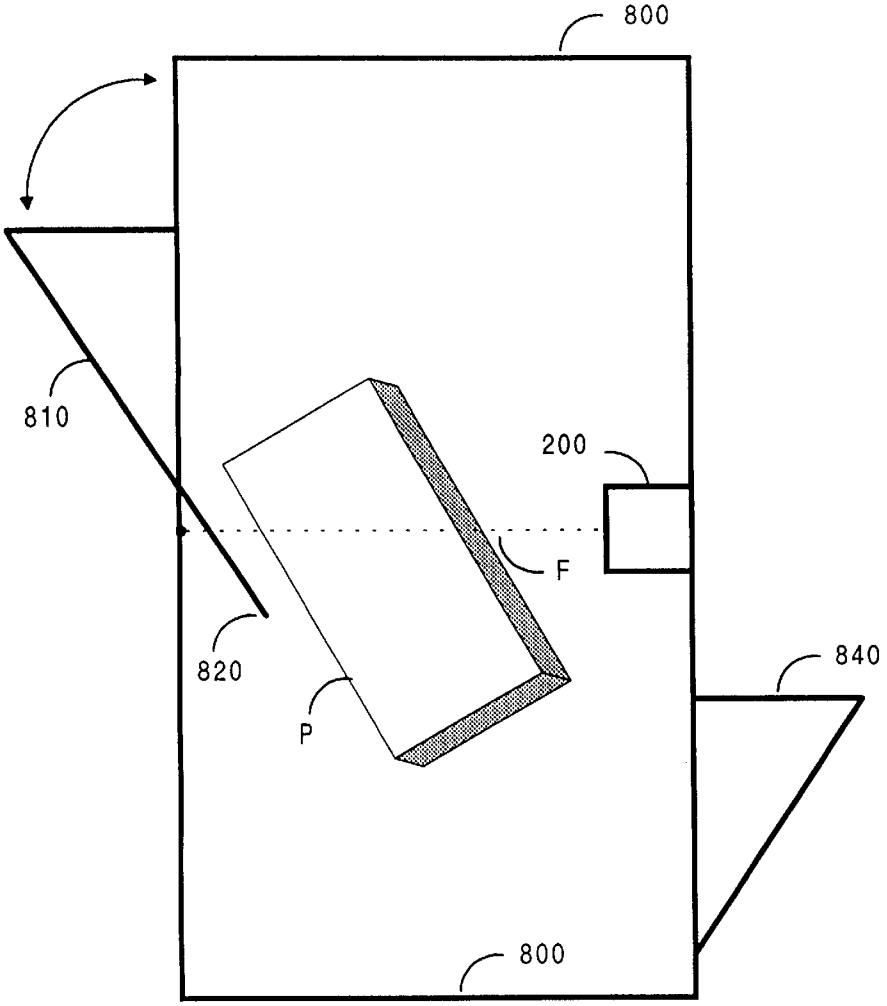
FIG. 2 is an illustration showing the deployment of a drop box inventory monitoring and control system according to one embodiment of the present invention.

Referring now to the drawings, wherein like characters designate like or corresponding parts throughout the several views, there is shown in FIG. 1 an inventory monitoring and control system 100 according a preferred embodiment of the present invention. System 100 includes a drop sensor 200 cooperatively coupled for communication through a network modem 300. The drop sensor 200, network modem 300 and a door switch 400 are each powered for operation by an AC/DC power supply 500. Any network, such as a network radio modem or a public service telephone modem, may be used as network modem 300 In such a manner, system 100 can monitor and control inventories contained, for example, within a drop box 800, 850 as shown in FIGS. 2 and 3. In a first embodiment, the drop sensor 200 passively detects the passage of packages into the drop box 800, 850, as more fully described below. In a second embodiment, the drop sensor 200 actively detects packages, such as the physical detection of packages by switches, such as a paddle switch. The door switch 400 senses that the courier has opened a locked access door (not shown) of drop box 800, 850 to pick-up packages and commands the network modem 300 to transmit a message that the packages have been picked up.

With reference first to the embodiment shown in FIG. 2, the drop sensor 200 is positioned within drop box 800 of the type having a first door 810 through which a patron deposits a package P. Attached to the first door 810 is an extension 820 which generally propels the package P into a downward trajectory within the drop box 800. Drop sensor 200 is, thus, positioned within the drop box 800 such that its sensing field F is generally parallel to the floor 830 of drop box 800. In a conventional manner, drop box 800 includes a second, courier door 840 for removal of the packages P deposited therein.

Drop box 850, as shown in FIG. 3, also includes a first door 810 which is adapted for receiving packages P deposited by a patron, and a second door 840 which permits the courier to remove those packages P deposited within drop box 850. It should be readily apparent from FIG. 3 that the first door 810 of drop box 850 does not include an extension 820 as does its counterpart drop box 800. In such cases, packages P may not break the sensing field F of the drop sensor 200 if positioned as shown in FIG. 2. Accordingly, the drop sensor 200 shown in FIG. 3 is positioned optimally to project its sensing field F downwardly across the drop box 850 so that, in the unlikely event that a package P falls in a generally parallel position with respect to the floor 830, such package P will nevertheless be sensed by the drop sensor 200. In accordance with a presently preferred embodiment of the invention, drop sensors 200 deployed within drop boxes 850 of the type shown in FIG. 3 should be positioned such that their sensing field F is approximately 35° below a line which is parallel to the floor 830 of those drop boxes 850.

Figure 4:
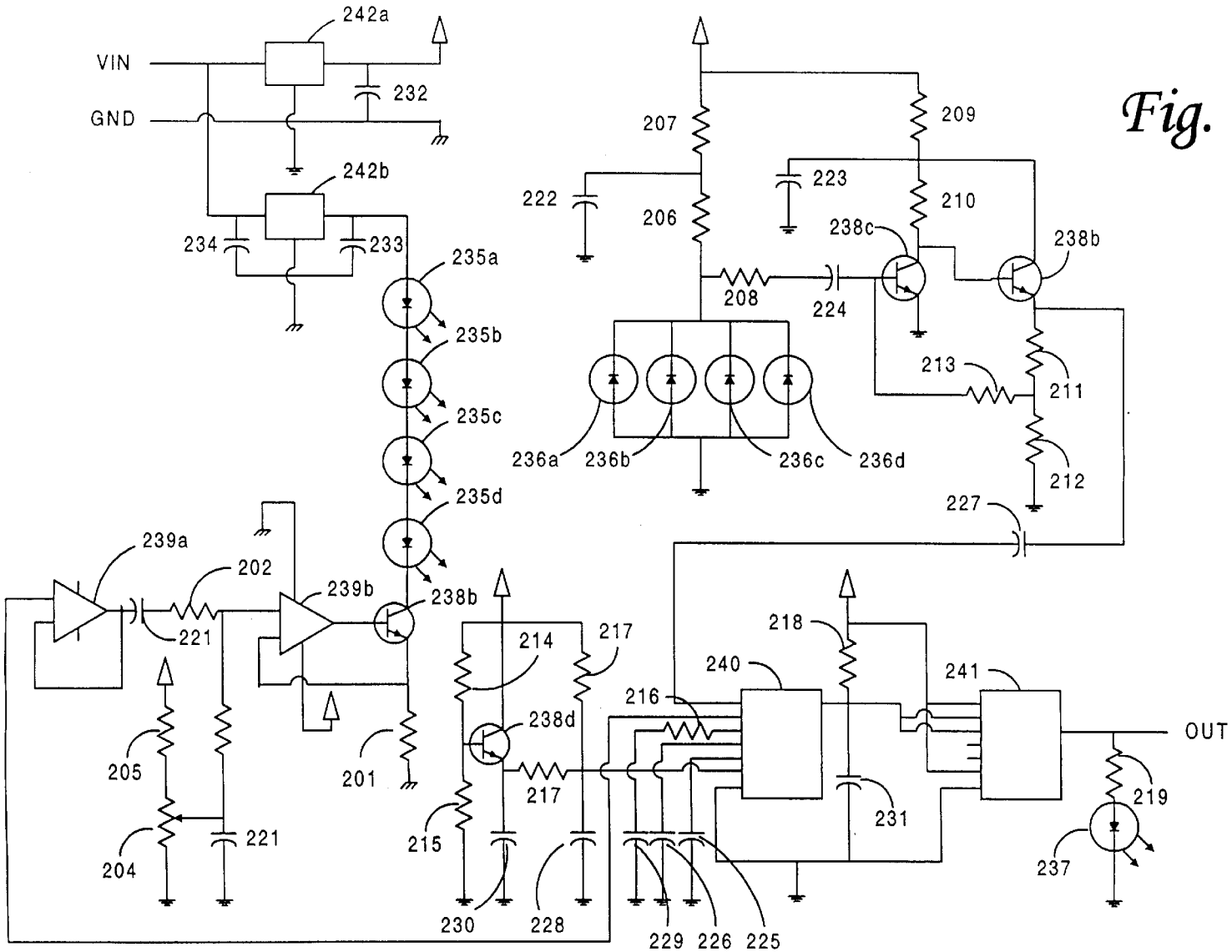
FIG. 4 is a schematic diagram of a preferred drop sensor according to the present invention.

As is shown in somewhat greater detail in FIG. 4, drop sensor 200 includes an operational amplifier 239*a* and 239*b* at the heart of its transmitter. Operational amplifier 239*a* and 239*b* preferably comprises an LM358 type operational amplifier, such as those manufactured by Motorola, Inc. or National Semiconductor. The transmit frequency drop sensor 200 will depend on its receiver's local oscillator frequency set by the RC network of tone decoder 240 (which preferably comprises an NE567 type tone decoder, such as those also manufactured by Motorola, Inc. or National Semiconductor). This signal is connected to the non-inverting input of the operational amplifier 239*b* in order to maintain the same frequency for the transmitter and the receiver sections of the invention. In this case, even if the frequency of the tone decoder 240 slightly varies due to temperature or other factors such as component tolerances, the performance of the drop sensor 200 will not be affected due to the fact that the transmitter and the receiver share the same local oscillator and therefore remain in synchronization from a frequency standpoint. Applying the exact same modulation/demodulation signal to both transmitter and receiver sections, versus attempting to "tune" one section's frequency to the other, is critical to maintaining a very inexpensive and highly manufacturable design which provides reliable performance over varying conditions. The only adjustment in this design is the user settable range potentiometer which is described next. The DC level is user tunable to set the distance parameter by adjusting the potentiometer 204 which regulates the current passing through the IR emitters/LEDs 235.

Transistor 238*a*, which is preferably a 2N3904 transistor of the type manufactured by Motorola, Inc., is placed in the feedback loop of operational amplifier 239*a*. Due to the feedback characteristics, the voltage at the non-inverting input is also the voltage across resistor 201 (and inverting input of operational amplifier 239*a*). The current through resistor 201 is forced into the emitter of transistor 238*a* and is approximately equal to the collector current of transistor 238*a*. This collector current flows through the IR emitter diode(s) 235 which convert the fluctuating current into an 890 nm intensity modulated light signal. These IR emitter diodes 235 receive DC power from an independent voltage regulator 242 to help prevent noise conduction into the receive.

According to one aspect of the present invention, an LM358-type operational amplifier 239 was selected because its output will swing to the negative rail (i.e., ground in this application). This trait is important in operational amplifier 239*a* where resistor 201 is reference to ground. Alternatively, a CMOS LMC662 can be used for low current operation. IR emitters 235 of the SFH484-2 type are also preferably employed because they have extremely high intensities at low currents and they are also lensed to have a narrow (i.e., about 8 degrees) 3 dB beam width. If one desires to further limit the beam width and field of view of drop sensor 200, heat shrink tubing can be placed around the IR emitters 235 and photodiodes 236 respectively.

The front end of drop sensor 200 consists of four photodiodes 236 placed in parallel. While phototransistors may be employed as alternatives to the photodiodes 236, it should be noted that the photodiodes 236 have much faster response times and are less susceptible to electromagnetic interference (EMI). Photodiodes 236 are also back-biased to 8V which decreases their capacitance and response time without significantly increasing dark current. In other words, the photodiodes 236 according to the present invention behave like linear intensity-controlled current sources with a wide dynamic range (i.e., greater than 90 dB). Therefore, when the modulated IR light impinges on the surface of the photodiodes 236, a fluctuating current is generated proportional to the fluctuating modulated intensity.

This current is AC coupled to the input of a two-transistor transimpedance amplifier (TRAMP) 238*b* and 238*c*. TRAMPs are preferably used because they have extremely low input impedance (current flows to the lowest impedance) and extremely low output impedance. In other words, they look like a voltage source to the load. Since such TRAMPs take current in, multiply it by a constant (gain) to provide a voltage input, the gain factor looks like a resistance or more generally an impedance; hence the name transimpedance.

Transistors 238*b* and 238*c* were selected, according to another important aspect of the present invention, over operational amplifiers to achieve good gain at 32 kHz. It should be noted, furthermore, that the bias on transistors 238*b* and 238*c* is critical to achieve the sensitivity (and, therefore, range) required for certain applications of the drop sensor 200 according to the present invention. In cases where more gain is required, a voltage amplifier could be capacitively coupled to the emitter of transistor 238*b*.

The output from transistor 238*b* is capacitively coupled to pin 3 of tone decoder 240. Integrated circuits of the type which are preferably employed as tone decoder 240 include a phase-locked loop (PLL) and a mixer. The PLL performs carrier (i.e., 32 kHz) recovery by synchronizing its current controlled oscillator (CCO) in quadrate with the frequency present on pin 3. This oscillator's signal is mixed with the signal on pin 3 which will yield an unambiguous measure of the incoming signal's amplitude. Therefor, tone decoder 240 acts as a Q-controllable bandpass filter and AM detector.

When the amplitude crosses a threshold established inside tone decoder 240, pin 8, an open collector NPN transistor is turned on. This discharges capacitor 233 to 0V, triggering pin 2 of timer 241, and causing pin 3 of the timer 241 to go high. This is the main output of the drop sensor 200 which also turns on an indicator LED 237. Pin 8 of the tone decoder 240 will remain low until the signal is removed from pin 3 of the tone decoder 240, holding capacitor 233 discharged. When the signal is removed from pin 3 of the tone decoder 240 (i.e., when a package P has passed the drop sensor 200), capacitor 233 will begin charging by current flowing through resistor 218. When the charge on capacitor 233 passes ⅔ $V_{CC}$ volts (i.e., 5.3V), the output of timer 241 will go back low again. The period of time during which the output remains high is given by the familiar expression:

$$t=1.1R_{24}C_{14}$$

Thus, for the values of $R_{24}$=33 k and $C_{14}$=47 μF, t=1.7 seconds.

Drop sensor 200, as illustrated previously with reference to FIGS. 2 and 3, will be located inside a drop box 800, 850 such that when a letter or package P is dropped inside the drop box 800, 850, the letter or package P will cut across the path of emitted modulated IR light (i.e., the sensing field F shown in FIGS. 2 and 3), reflect some of that light and trigger the drop sensor 200. The output signal of the drop sensor 200 will be high for 1.7 seconds providing a countable pulse which can be used to estimate the number of drops occurring during a certain period. When the drop box 800, 850 is full, the sensor will be blocked by the letters or packages P and the output will held high indicating a full box. Because of varying drop box designs and applications, maximum sensitivity is critical for a universal design to be effective across the board. The number and spacing of IR emitter 235 and photodiode 236 pairs is determinative of the width of the path covered and the resolution of the drop sensor 200 (i.e., the minimum size of the object to be sensed). Table I below sets forth illustrative values for each of the elements shown in the drop sensor 200 according to FIG. 4.

TABLE I

| Element | Component | Type | Manufacturer |
|---|---|---|---|
| 201 | Resistor | 22 Ω, 5%, ¼ W | Any |
| 202 | Resistor | 1 kΩ, 5%, ¼ W | Any |
| 203 | Resistor | 10 kΩ, 5%, ¼ W | Any |

TABLE I-continued

| Element | Component | Type | Manufacturer |
|---|---|---|---|
| 204 | Potentiometer | 100 kΩ | Any |
| 205 | Resistor | 1MΩ, 5%, ¼ W | Any |
| 206 | Resistor | 10 kΩ, 5%, ¼ W | Any |
| 207 | Resistor | 1 kΩ, 5%, ¼ W | Any |
| 208 | Resistor | 0 Ω, 5%, ¼ W | Any |
| 209 | Resistor | 1 kΩ, 5%, ¼ W | Any |
| 210 | Resistor | 5.6 kΩ, 5%, ¼ W | Any |
| 211 | Resistor | 3.3 kΩ, 5%, ¼ W | Any |
| 212 | Resistor | 1 kΩ, 5%, ¼ W | Any |
| 213 | Resistor | 56 kΩ, 5%, ¼ W | Any |
| 214 | Resistor | 10 kΩ, 5%, ¼ W | Any |
| 215 | Resistor | 33 kΩ, 5%, ¼ W | Any |
| 216 | Resistor | 33 kΩ, 5%, ¼ W | Any |
| 217 | Resistor | 22 Ω, 5%, ¼ W | Any |
| 218 | Resistor | 33 kΩ, 5%, ¼ W | Any |
| 219 | Resistor | 1 kΩ, 5%, ¼ W | Any |
| 220 | Capacitor | 0.047 μF, 0.1" LS, Y5V or X7R | AVX |
| 221 | Capacitor | 0.047 μF, 0.1" LS, Y5V or X7R | AVX |
| 222 | Capacitor | 47 μF, 10 V, Electrolytic, 20% | Illinois Capacitor |
| 223 | Capacitor | 47 μF, 10 V, Electrolytic, 20% | Illinois Capacitor |
| 224 | Capacitor | 0.047 μF, 0.1" LS, Y5V or X7R | AVX |
| 225 | Capacitor | 0.047 μF, 0.1" LS, Y5V or X7R | AVX |
| 226 | Capacitor | 0.01 μF, 0.1" LS, X7R | AVX |
| 227 | Capacitor | 0.047 μF, 0.1" LS, Y5V or X7R | AVX |
| 228 | Capacitor | 47 μF, 10 V, Electrolytic, 20% | Illinois Capacitor |
| 229 | Capacitor | 1000 pF, 0.1" LS, COG | AVX |
| 230 | Capacitor | 0.047 μF, 0.1" LS, Y5V or X7R | AVX |
| 231 | Capacitor | 47 μF, 10 V, Electrolytic, 20% | Illinois Capacitor |
| 232 | Capacitor | 10 μF, 25 V, Electrolytic, 20% | Illinois Capacitor |
| 233 | Capacitor | 10 μF, 25 V, Electrolytic, 20% | Illinois Capacitor |
| 234 | Capacitor | 10 μF, 25 V, Electrolytic, 20% | Illinois Capacitor |
| 235 | IR Emitter | FH484-1 or SFH484-2 | Siemens |
| 236 | Photodiode | SFH2030 | Siemens |
| 237 | Red LED | Generic | Any |
| 238 | Transistor | 2N3904 | Motorola |
| 239 | Operational amplifier | LM358 | Motorola, National |
| 240 | Tone decoder | NE567 | Motorola, National |
| 241 | Timer | LM555 | Motorola, National |
| 242 | Voltage regulator | LM7808 | Motorola, National |

Of course, all the electronics used in the drop sensor 200 according to the present invention have low power CMOS equivalents that can be used at a slightly higher manufactured cost. However, such CMOS equivalents will reduce the operating power of the drop sensor 200 to about ½ the bipolar IC consumption of the presently preferred device. This would, nevertheless, be convenient for long-term battery and/or solar power operation as shown in the alternative embodiment of the present invention illustrated in FIG. 8.

In accordance with a presently preferred embodiment of the invention, the network modem 300 (FIG. 1) comprises a self-contained subscriber radio such as the Ademco 7720 subscriber radio manufactured by Alarm Device Manufacturing Company, a division of Pittway Corporation. Such a subscriber radio provides for the transmission of all alarm and status messages to the communications network 700 via radio signals, which means faster and more secure reporting. The entire radio link equipment, including interface, transmitter, power supply, battery and antenna may be housed in a single unit, requiring only battery charging power and alarm inputs. Alternatively in a second embodiment, the network modem 300 may be a public service telephone network modem.

The network modem 300 receives alarm and status messages from the drop sensor 200 and door switch 400 and converts these signals to radio messages which are transmitted, through communications channel 600, to the communications network 700, which in turn relays the messages to a PC network (not shown). Communications channel 600 may be an antenna when the network modem is a network radio modem or it may be a telephone wire if network modem 300 is a telephone network mode. If the communications channel is an antenna, the antenna should preferably comprise an omni-directional antenna. The network modem 300 is adapted to transmit periodic supervisory messages to alert the dispatcher at the PC network.

The monitoring and control system according to the present invention allows a variety of field-based courier pickup sites to be monitored passively for the presence or absence of a package ready for pickup, an indication that the site is approaching or at capacity, an indication that the courier has completed daily pickup and/or a sweep of the facility, and allow for the inclusion of additional indications such as supply outages, tampering, etc. as required.

The system should be run on a "high-end" IBM compatible Intel 486 based machine (or its equivalent) operating as a Microsoft Windows application. Three main presentation windows are available to the user: (1) a GIS system from visual survey of the status of a particular area; (2) an asset management window, displaying a text account of the status of each drop box within the purview of the courier; and (3) an action items window which can scroll messages sequentially as received.

The system is functionally split into two separate operating environments. A "real-time" system will hold and maintain system and site data for a twenty-four hour period, which begins and ends at the time the box was picked up for the final time by the courier. This implies that the 24-hour clock can be distinct for each facility.

An historical system will maintain data for the last quarter (on a rolling basis) before archiving it to file. This data will include number of drops and time of pickups for the location, and allow for both query for specific information, and the preparation of management reporting and trending tools. At no time will data be discarded without backup to file.

The two management elements of the real time system are the presentation manager and reports generator. The presentation manager will be configured to display the following information.

A color coded dot location of drop boxes on a local geographic map. The map is based on data provided by the U.S. Census Bureau, and is not intended to provide specific routing instructions for the courier. The color codes for the dots may be as follows:

| | |
|---|---|
| Black | No data (implies communications failure) |
| Blue | Empty box (period of one hour after courier pickup and sweeps) |
| Flashing blue | Empty box (period of one hour before scheduled pickup) |
| Flash blue to red | (1) Site requiring pickup, previously indicated or reported or acknowledged empty (2) Site picked up earlier than posted schedule with a package drop before scheduled time |
| Yellow | Site with drops |
| Flashing yellow | Site with drops approaching box capacity |
| Red | Site with drops, courier pickup more than 15 minutes late |
| Flashing red | Site with drops, courier pickup more than 30 minutes late |

FIG. 5 shows the information and layout of the asset management window. The window is intended to depict the short description of the box, as well as pending actions recommended and taken. The records should have multiple indices for sorting, to includes COSMOS ID and Route Number, Current Status, Route Number and Pickup Time, and Messages and Route Number.

By double clicking on a line, a further window will be opened to display the complete information record for the box. This will include all fixed asset information, and the last five (5) status messages. FIG. 6 shows the information layout for this window.

An "Action Items" window, which is intended to display the alarms and other information generated by the monitoring and control system according to the present invention, provides text information regarding the status of the system, status of a particular box, and the items that the management system requires operator/dispatcher action on.

Figures 7, 8:
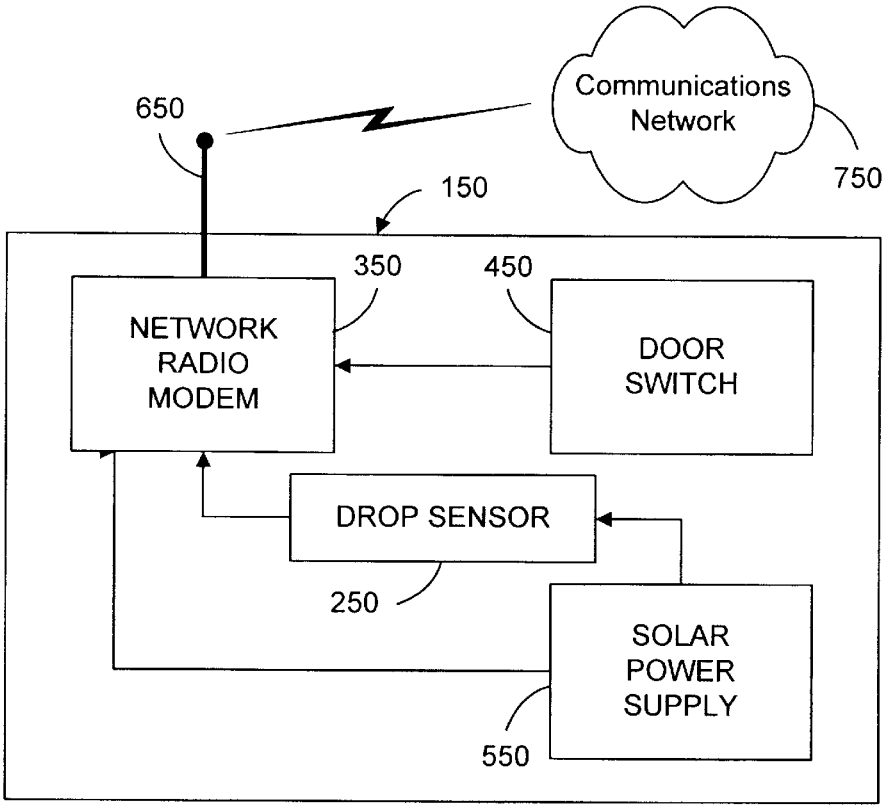
FIG. 7 is an illustration of an action items window used in an application of the drop box inventory monitoring and control system according to the present invention.
FIG. 8 is a block diagram of a drop box inventory monitoring and control system according to another embodiment of the present invention.

There are three levels of items which can be displayed: (1) information items (e.g., drop activity and courier activity); (2) maintenance activity (e.g., low power and communication inactivity); and (3) immediate action items (e.g., sweep required, pickup late, no drops at site within one-half (½) hour of scheduled pickup. The layout of this window is shown in FIG. 7. A given message will remain in the queue until action is taken, or acknowledgment is made. Messages will then be displayed based on the operator's selection of one or all of the above categories, chronologically with the latest first.

There are three general types of reports which can be generated by the monitoring and control system according to the present invention. A pickup status report lists drops boxes by route and zip code, with a calculated number of drops, percent fill and date and time of last pickup or sweep designated. A courier demand report is designed to alert the dispatcher of courier actions pending, as well as actions that may become necessary. The formatted report displays the sites that contain no drops at the top of the list. The remaining sites are sorted from the highest percent fill of the site, to the lowest. A route reconciliation report is designed to provide a site by site reconciliation of the number of drops placed in the box, the time the courier picked up the box, and the minutes the courier deviated from the posted pickup time., The report provides the dispatcher a means of determining if a site has been picked up early, and whether further action might be required for that specific site. The report additionally provides management a means of independently auditing the tracker based reports on site productivity.

There are four message types transmitted from field location to the dispatch office. They are: (1) status message; (2) courier door open message; (3) drop message; and (4) box full message. The status message is a one byte health and welfare status of the location radio equipment used to determine (a) that the radio and power situation is normal, and (b) a low battery situation requiring positive action by the user. Health and welfare messages are normally sent every six hours. The courier door open message is a one byte message indicating the courier door sensor has been activated. The drop message is a one byte message indicating that an object has activated the drop sensor. The box full message is a one byte message indicating that the drop sensor has been interrupted for more than five (5) seconds, implying that the box is full.

The following criteria are used to determine the status of a location throughout the monitoring and control system according to the present invention. Box empty—the box is declared empty when it meets any of the following conditions. Immediately after a courier has made the last pickup for the day. The courier "at location" time is assumed to be two minutes. Drop sensor activation during the two minutes immediately following the courier door open sensor is assumed to be caused by the courier in conduct of his work. Immediately after a courier has made the sweep. The courier "at location" time is assumed to be two minutes. Drop sensor activation during the two minutes immediately following the courier door open sensor is assumed to be caused by the courier in conduct of his work. Until one hour after a scheduled location status message in the absence of a drop message.

Loc_empty=TRUE

IF (Courier_time<=(NOW−2 minutes)

OR IF (Drop=FALSE) AND (Status=OK)

OR IF (Drop=False) AND (Status_Time+60 minutes<=NOW)

Package drop. A box is declared to have a package and require a courier to service the box under the following conditions. The drop sensor has activated outside of the two minute courier servicing timeframe. The box full indication is received.

Pkg_drop=TRUE

IF (Drop=TRUE AND Courier_time<(NOW−2 minutes))

OR IF (Box_Full=TRUE) AND Courier_time<(NOW−2 minutes))

Box full. A box is declared full under the following conditions. If the box full indication is received by the system. If the calculated percent fill is in excess of 150%.

Box_full=TRUE

IF (Full_Indic=TRUE) OR IF (Pkg_Count>=1.5*Pkg_Capacity)

No data. A box is declared in a maintenance required condition as follows. The box sends a low battery or lost commercial power indication. The box fails to communicate status for a period of one hour after a scheduled status message.

Mtce_Fail=TRUE

IF (Low_Btry=TRUE)

OR IF (Coml_Pwr=FALSE)

OR IF (Status=FALSE AND Status_Time+300 minutes>NOW)

Box swept. The box will be declared swept, the sweep time recorded, and the package counter reset to zero under the following conditions. The courier door is opened when the time associated with the opening is greater than 10 minutes before the preassigned pickup time, and the dispatcher acknowledges a sweep, or a sweep had been previously scheduled. The purpose of the acknowledgment is to determine if the package counter should be set to zero.

Box_Swept=TRUE

IF(Courier_Time<(Sch_Pick_Time−10 minutes) AND (Sweep_Sch=TRUE OR (ACK_Sweep=TRUE)

Box pickup up. The box will be declared "picked up", pick up time recorded and package counter reset to zero under the following conditions: the courier door is opened when the time associated with the opening is less than ten minutes>

Box_Picked=TRUE

IF (Courier_Time>(Sch_Pick_Time−10 minutes))

Sweep recommended. The box will be flagged for a recommended sweep if the following conditions are met. The box full flag is set; or the box is at more than 80% capacity with more than two hours remaining before the scheduled pickup time.

REC_Sweep=TRUE

IF (Box_Full=TRUE) OR IF (Pkg_Count>=Pkg_Capacity*0.8 AND NOW<Sch_Pick_Time−120 minutes)

Package missed. The box will be declared to have a package missed under the following conditions. A package is dropped in a box after the courier has picked up the box, but before the site's scheduled pickup time. A box has not been picked up in excess of 30 minutes after the scheduled pickup time.

Pkg_Missed=TRUE

IF (Pkg_Count>0) AND IF (Box Picked=FALSE AND NOW>(Sch_Pick_Time+30 minutes))

OR IF (Courier_Time+10 minutes<+Sch_Pick_Time AND Pkg_Drop=TRUE)

Box status control. The box status flag is used to determine the health and welfare of the communications and sensor devices at the location. The flag will be initialized at TRUE and be set to FALSE under the following conditions. If monitoring and control system has not received a status message from the box in excess of one hour after the scheduled time to receive the message. And if the monitoring and control system has not received any other message from the site within the last two hours.

Status=TRUE

IF (Last_Status+Status_Interval+60 minutes)<NOW AND

IF (Last_Msg_Time+120 minutes<NOW)

The monitoring and control system according to the present invention also contains a maintenance module which may run as a background application. The purpose of the module is to provide automatic notification of network, hardware and environmental problems to the appropriate group responsible for its upkeep.

The module will via a PC Fax board format and automatically deliver to a remote facsimile machine notice of the failure, as well as the pertinent details of the location. The following notification sites are recommended: (1) Power failure—Appropriate dispatcher to ensure that local commercial power is available; (2) Battery low—Appropriate dispatcher to ensure that local commercial power is available; and (3) Communications failure—service provider.

Dispatcher log-in module. A module is provided to log-in and record the system operator, and to stamp any actions taken via the system with the dispatcher's initials for future identification. Employee numbers will be used to enter the system, and a look up table used to identify the person by name and initials. A supervisor level password will be maintained to initialize and set up the system. This module is not intended to provide any more than cursory security and verification of individual dispatcher actions. The system is not intended to keep unauthorized individuals from using the monitoring and control system.

Figure 9:
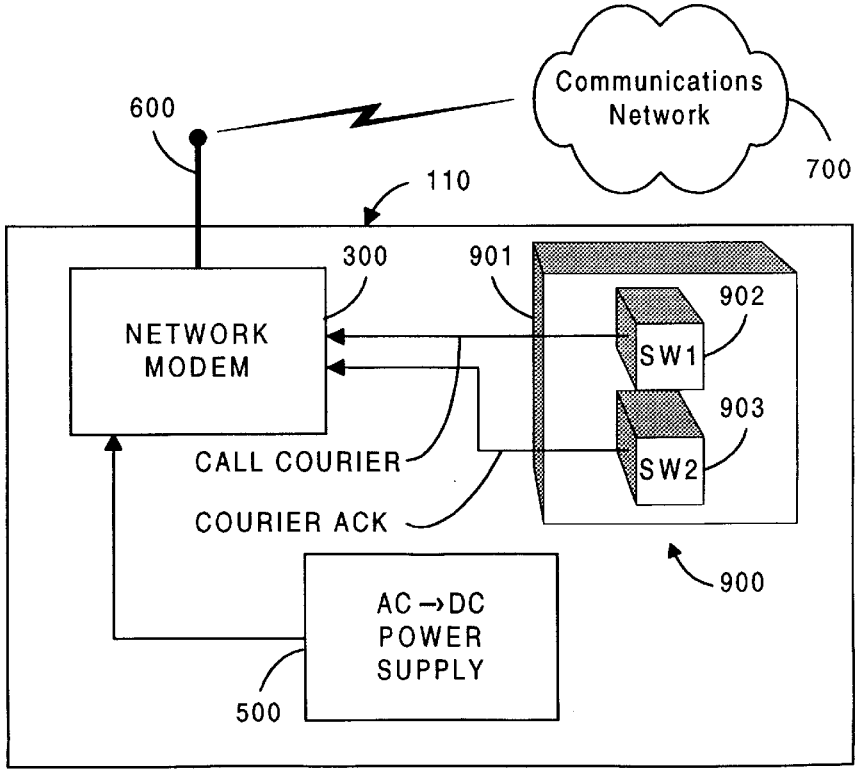
FIG. 9 is a block diagram of a call box inventory monitoring and control system according to a presently preferred embodiment of the invention.
Figure 10:
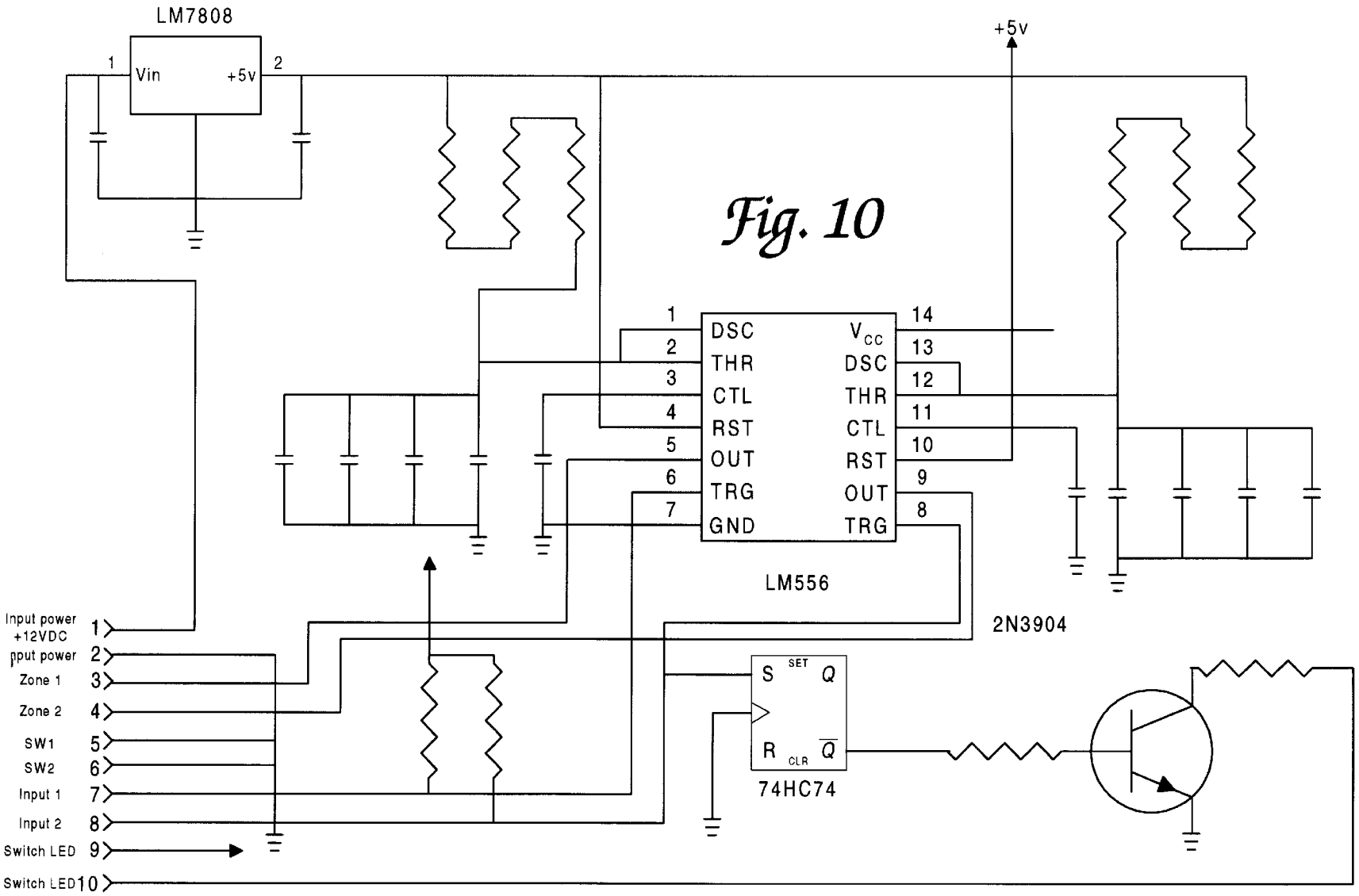
FIG. 10 is a schematic diagram of a call box according to the present invention.

FIGS. 9 and 10 illustrate an inventory monitoring and control system 110 according a second embodiment of the present invention. System 110 includes a call box 900 cooperatively coupled for communication through a network modem 300. The network modem 300 is powered for operation by an AC/DC power supply 500. Any network, such as a network radio modem or a public service telephone modem, may be used as network modem 300 In such a manner, system 110 is activated to transmit a message that packages need to be picked up and to transmit a message that the packages have been picked up.

Call box 900 comprises a small chasis 901 having two momentary push button switches 902 and 903. Push button 902 illuminates a lamp (not shown) when actuated and triggers the network modem to transmit a "package waiting" message to a courier company. The "package waiting" message is transmitted to the courier company as described above. The lamp is latched on once push button switch 902 is actuated. When the courier arrives at the customer location to pick up the packages, the courier actuates push button 903. Push button 903 when actuated unlatches the lamp to turn it off and triggers the network modem 300 to transmit an "acknowledgement" message to the courrier company dispatcher. FIG. 10 illustrates a preferred embodiment of the electronics for call box 900.

What we claim as our invention is:

1. Apparatus for monitoring and controlling pickup of packages deposited in a system of drop boxes, each such drop box being adapted to receive a plurality of packages through a door, comprising:

a drop sensor, adapted to sense the deposit of any of a plurality of packages through the door, which generates a plurality of signals;

means for communicating at least one of said signals indicative of the deposit of any one of said plurality of packages through the door to a remote location;

a power supply operatively coupled to said drop sensor and said communicating means for providing source of power thereto;

wherein said plurality of signals comprise a first signal responsive to the deposit of any one of said plurality of packages; and a second signal responsive to a condition approximating a capacity of the drop box.

2. The apparatus according to claim 1, wherein said power supply comprises an AC power supply.

3. The apparatus according to claim 1, wherein said power supply comprises a solar power supply.

4. The apparatus according to claim 1, wherein said second signal further comprises:

a completely full signal responsive to a second condition wherein the drop box is at 100% capacity.

5. The apparatus according to claim 1, further comprising a pickup signal indicative of a condition whereby the courier has completed his daily pickup of the drop box.

6. The apparatus according to claim 1, wherein said communicating means comprises a wireless network.

7. The apparatus according to claim 1, wherein said communicating means comprises a wired network.

8. The apparatus according to claim 1, wherein said drop sensor passively detects the passage of packages into said drop box.

9. The apparatus according to claim 1, wherein said drop sensor actively detects the passage of packages into said drop box.

10. The apparatus according to claim 1, further comprising a status signal indicative of a radio and a power condition of the drop box.

11. The apparatus according to claim 1, further comprising a dispatcher log-in module to log-in and record the system operator and to stamp any actions taken with the operator's initials.

12. The apparatus according to claim 1, further comprising a maintenance module to provide automatic notification of network, hardware and environmental problems related to the drop box.

13. The apparatus according to claim 12, wherein said maintenance module further comprises a fax board.

14. The apparatus according to claim 1, wherein said communicating means comprises:

a communications network; and a modem adapted to communicate with said communications network.

15. The apparatus according to claim 14, wherein said communication network comprises Alarmnet.

16. The apparatus according to claim 14, wherein said modem comprises a network radio modem.

17. The apparatus according to claim 14, wherein said communications network comprises a transmitter and a receiver.

18. The apparatus according to claim 17, wherein said transmitter and said receiver are tuned to the same frequency.

19. The apparatus according to claim 17, wherein said receiver is a PC network for receiving said signals.

20. The apparatus according to claim 19, wherein said PC network further comprises two separate operating environments wherein said first operating environment is a "real-time" environment for maintaining site data for a 24 hour period, and said second operating environment is an historical environment for maintaining site data for the last quarter.

21. The apparatus according to claim 19, wherein said PC network further comprises three main presentation windows, said first window is an asset management window, whereby the status of each drop box within the purview of a courier is displayed, said second window is an action items window, whereby alarms and status information concerning a particular drop box is displayed, and said third window is a GIS window, whereby the status of a particular area can be surveyed.

22. The apparatus according to claim 19, wherein said PC network further comprises two separate operating environments wherein said first operating environment is a "real-time" environment for maintaining site data for a 24 hour period, and said second operating environment is an historical environment for maintaining site data for the last quarter.

23. A method for monitoring and controlling pickup of packages deposited in a system of drop boxes, wherein each such drop box is adapted to receive a plurality of packages through a door, comprising:

using a sensor to sense the deposit of any of a plurality of packages through the door;

using said sensor to generate a plurality of signals;

communicating one or more of said signals indicative of the deposit of any of said plurality of said packages through the door to a remote location;

wherein said step of communicating said plurality of signals comprises providing a first signal responsive to the deposit of any of said plurality of said packages; and providing a second signal responsive to a condition approximating a capacity of the drop box.

24. The method according to claim 23, wherein said power supply comprises an AC power supply.

25. The method according to claim 23, wherein said power supply comprises a solar power supply.

26. The method according to claim 23, wherein said step of providing said second signal further comprises:

thereafter providing a completely fill signal responsive to a second condition wherein the drop box is at 100% capacity.

27. The method according to claim 23, further comprising the step of providing a pickup signal indicative of a condition whereby the courier has completed his daily pickup of the drop box.

28. The method according to claim 23, wherein said sensing step comprises passively sensing the passage of packages into said drop box.

29. The method according to claim 23, wherein said sensing step comprises actively sensing the passage of packages into said drop box.

30. The method according to claim 23, further comprising a status signal indicative of a radio and a power condition of the drop box.

31. The method according to claim 23, further comprising a log-in step for logging in and recording the system operator and for stamping any actions taken with the operator's initials; and providing a signal responsive to said logging-in.

32. The method according to claim 23, further comprising providing a maintenance signal indicative of network, hardware and environmental problems related to the drop box.

33. The method according to claim 32, wherein said step for providing a maintenance signal further comprises using a fax board to generate said maintenance signal.

34. The method according to claim 23, wherein said communicating step comprises:

providing a communications network; and providing a modem adapted to communicate with said communications network.

35. The method according to claim 34, wherein said communication network comprises Alarmnet.

36. The method according to claim 34, wherein said modem comprises a network radio modem.

37. The method according to claim 34, wherein said modem comprises a public service telephone network modem.

38. The method according to claim 34, wherein said communications network comprises the steps of transmitting and receiving.

39. The method according to claim 38 wherein said transmitting step and said receiving step are done at the same frequency.

40. The method according to claim 38, further comprising the step of using a PC network for receiving said signals.

41. The method according to claim 40, wherein said PC network further comprises three main presentation windows, said first window is an asset management window, whereby the status of each drop box within the purview of a courier is displayed, said second window is an action items window, whereby alarms and status information concerning a particular drop box is displayed, and said third window is a GIS window, whereby the status of a particular area can be surveyed.

42. The method according to claim 40, wherein said PC network further comprises two separate operating environments wherein said first operating environment is a "real-time" environment for maintaining site data for a 24 hour period, and said second operating environment is an historical environment for maintaining site data for the last quarter.

43. The apparatus according to claim 1, further comprising a pickup signal which is automatically generated when the courier has completed his daily pickup of the drop box.

44. The apparatus according to claim 1, further comprising a sensor which generates a pickup signal indicative of a condition whereby the courier has completed his daily pickup of the drop box.

45. An apparatus for monitoring and controlling pickup of packages deposited in a system of drop boxes, each such drop box being adapted to receive a plurality of packages through a door, comprising:

a drop sensor, adapted to sense the deposit of a package through the door, which generates one or more signals;

means for communicating at least one of said signals indicative of the deposit of said package through the door as a courtable pulse, whereby it can be used to estimate the number of drops occurring during a certain period and the time when said drop occurred; and a power supply operatively coupled to said drop sensor and said communicating means for providing source of power thereto.

46. The method according to claim 23, further comprising the step of providing a pickup signal which is automatically generated when the courier has completed his daily pickup of the drop box.

47. The method according to claim 23, further comprising the steps of:

sensing when the courier has completed his daily pickup of the drop box; and generating a pickup signal indicative of a condition whereby the courier has completed his daily pickup of the drop box.

48. A method for monitoring and controlling pickup of packages deposited in a system of drop boxes, wherein each such drop box is adapted to receive a plurality of packages through a door, comprising:

sensing the deposit of a package through the door;

generating one or more signals;

communicating one or more of said signals indicative of the deposit of said package through the door; and providing a countable pulse which is indicative of the number of drops occurring during a certain period and the time when said drop occurred.

* * * * *